US008556124B2

(12) United States Patent
Edwards

(10) Patent No.: US 8,556,124 B2
(45) Date of Patent: Oct. 15, 2013

(54) BAG IN BOX PACKAGING HAVING A TAP ARTICULATING ASSEMBLY

(75) Inventor: Simon P. Edwards, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 13/338,514

(22) Filed: Dec. 28, 2011

(65) Prior Publication Data

US 2012/0217266 A1 Aug. 30, 2012

Related U.S. Application Data

(63) Continuation of application No. PCT/US2010/040662, filed on Jun. 30, 2010.

(60) Provisional application No. 61/269,868, filed on Jun. 30, 2009.

(51) Int. Cl.
*B65D 35/56* (2006.01)

(52) U.S. Cl.
USPC ..... 222/105; 222/538; 229/117.3

(58) Field of Classification Search
USPC ..... 222/105, 185.1, 528–539; 229/117.3
See application file for complete search history.

(56) References Cited

U.S. PATENT DOCUMENTS

| | | | | | |
|---|---|---|---|---|---|
| 36,478 | A * | 9/1862 | Phelps | 222/481 |
| 4,169,548 | A * | 10/1979 | Bond | 222/505 |
| 4,174,051 | A * | 11/1979 | Edwards et al. | 222/105 |
| 4,314,654 | A * | 2/1982 | Gaubert | 222/83 |
| 4,322,018 | A * | 3/1982 | Rutter | 222/83 |
| 4,355,737 | A * | 10/1982 | Pongrass et al. | 222/81 |
| 4,475,670 | A * | 10/1984 | Rutter | 222/83 |
| 4,493,438 | A * | 1/1985 | Rutter | 222/83 |
| 4,572,422 | A * | 2/1986 | Heuberger et al. | 229/117.3 |
| 4,722,458 | A * | 2/1988 | Van Dal | 222/105 |
| 4,919,306 | A * | 4/1990 | Heaps et al. | 222/105 |
| 8,225,958 | B2 * | 7/2012 | Nielsen et al. | 220/720 |
| 2003/0183650 | A1 * | 10/2003 | Muise et al. | 222/105 |
| 2009/0084834 | A1 * | 4/2009 | Duyst | 229/117.3 |
| 2009/0159594 | A1 * | 6/2009 | Nielsen et al. | 220/8 |
| 2011/0036864 | A1 * | 2/2011 | McKenna | 222/105 |
| 2012/0217265 | A1 * | 8/2012 | Edwards | 222/105 |

* cited by examiner

*Primary Examiner* — Kevin P Shaver
*Assistant Examiner* — Patrick M Buechner
(74) *Attorney, Agent, or Firm* — The Watson I.P. Group, PLC; Jovan N. Jovanovic; Vladan M. Vasiljevic

(57) ABSTRACT

A bag in box packaging including an outer box, an inner bag and a tap. The outer box has a bottom wall and a front wall. A tap articulating assembly includes a tap wall and at least two spaced apart hinge assemblies. The tap wall has an opening to receive the tap. The hinge assemblies each have a first hinge panel and a second hinge panel. Each first and second hinge panel are joined to each other at an intermediate hinge fold, with the first hinge panel joined to the tap wall at a fold and the front wall or a respective side wall at a fold. The hinge assembly provides for a shipping orientation wherein the tap wall is recessed to substantially retain the tap within a footprint of the outer box to an dispensing orientation wherein the tap extends beyond the footprint.

13 Claims, 5 Drawing Sheets

BAG IN BOX PACKAGING HAVING A TAP ARTICULATING ASSEMBLY

CROSS-REFERENCE TO RELATED APPLICATION

This is a continuation of PCT Int'l App. No. PCT/US2010/040662 filed Jun. 30, 2010, entitled "Bag In Box Packaging Having a Tap Articulating Assembly" which claims priority from U.S. Prov. Pat. App. Ser. No. 61/269,868 filed Jun. 30, 2009, entitled "Bag In Box Packaging Having a Tap Articulating Assembly", the entire specification of each of the applications is incorporated herein by reference in their entirety.

BACKGROUND OF THE DISCLOSURE

1. Field of the Disclosure

The disclosure relates in general to bag in box packaging, and more particularly, to a bag in box packaging that has a locating panel for a tap.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE DISCLOSURE

The disclosure is directed to a bag in box packaging comprising an outer box, an inner bag and a tap. The outer box has a bottom wall and a front wall with an opening toward the lower end thereof. The inner bag has a spout with a tap. The a tap articulating assembly includes a tap wall and at least two hinge assemblies. The tap wall has an opening with the tap extending through the opening. The hinge assemblies each have a first hinge panel and a second hinge panel. The first and second hinge panels of each hinge assembly are joined to each other at an intermediate hinge fold, with the first hinge panel joined to the tap wall at an inner hinge fold and to one of the front wall and a respective side wall at an outer hinge fold. The first hinge assembly being spaced apart from the second hinge assembly. The hinge assembly provides for a shipping orientation wherein the tap wall is recessed so as to substantially retain the tap within a footprint of the outer box to an dispensing orientation wherein the tap extends beyond the footprint of the outer box.

In a preferred embodiment, the tap wall and the at least two hinge assemblies are formed into the front wall. Additionally, the opening of the outer box extends about a bottom edge of the front wall.

In another preferred embodiment, the intermediate hinge fold, the inner hinge fold and the outer hinge fold of the first hinge assembly intersect at a point on the front wall. Similarly, the intermediate hinge fold, the inner hinge fold and the outer hinge fold of the second hinge assembly intersect at a point on the front wall which is spaced apart from the intersection of the folds of the first hinge assembly.

In another preferred embodiment, the folds of the first hinge assembly intersect at a corner of the front wall and the folds of the second hinge assembly intersect at a corner of the front wall.

In another preferred embodiment, the folds of the first hinge assembly and the folds of the second hinge assembly are mirror images of each other about a central axis extending longitudinally about the front wall.

Preferably, each of the first hinge panel and the second hinge panel comprise substantially triangular shaped structures.

In a preferred embodiment, the tap wall comprises a substantially trapezoidal shaped structure.

In another preferred embodiment, the tap wall substantially corresponds to the opening so that when the tap wall is placed into the dispensing orientation, the tap wall substantially corresponds to the opening thereby providing a substantially uniform front wall.

Preferably, the at least two hinge assemblies extend from opposite sides of the opening in the front wall.

In a preferred embodiment, each of the first hinge panel and the second hinge panel are substantially identical in configuration and substantially comprise rectangular configurations.

In one embodiment, a third hinge assembly is positioned above the tap.

Preferably, each of the hinge assemblies are substantially identical in configuration.

In a preferred embodiment, a frangible cover is positioned over the opening in the front wall to preclude inadvertent contact with the tap in the shipping configuration.

In another preferred embodiment, the tap wall comprises a substantially pentagonal configuration.

Preferably, each of the hinge assemblies are substantially independent of each other between the outer hinge fold and the inner hinge fold and are configured for substantially independent movement relative to each other.

BRIEF DESCRIPTION OF THE DRAWINGS

The disclosure will now be described with reference to the drawings wherein.

DETAILED DESCRIPTION OF THE DISCLOSURE

Figure 1A:
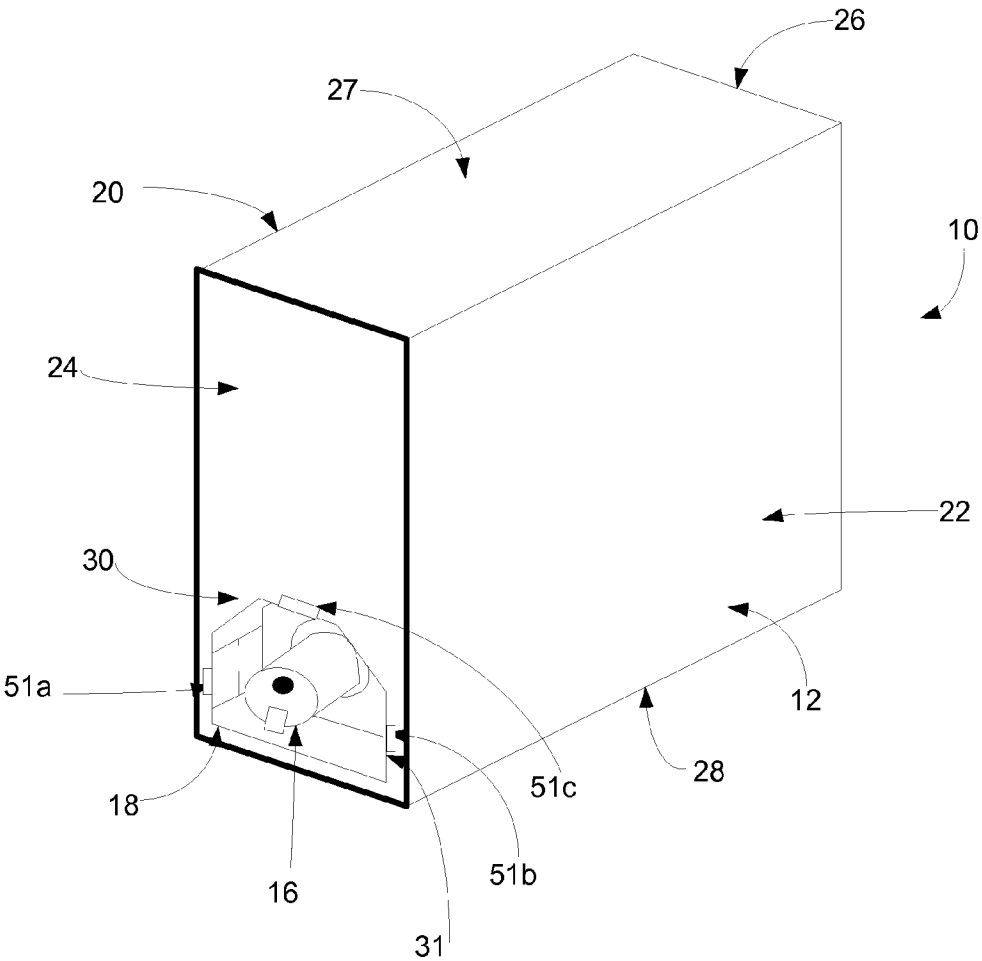
FIG. 1*a* of the drawings is a perspective view of a bag in box package made in accordance with the teachings of the present invention, showing in particular, the tap in a storage and shipping position.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, bag in box packaging is shown generally at 10. The bag in box packaging can be utilized in association with any number of different flowable materials. Inasmuch as one feature of the invention is the location of a tap, one use of the bag in box packaging is its use in association with wine products and the like. It will be understood that the invention is not limited to its use in association with wine products, and such use is described only for purposes of being exemplary. In other embodiments, other fluids can be utilized in its stead.

Figure 1B:
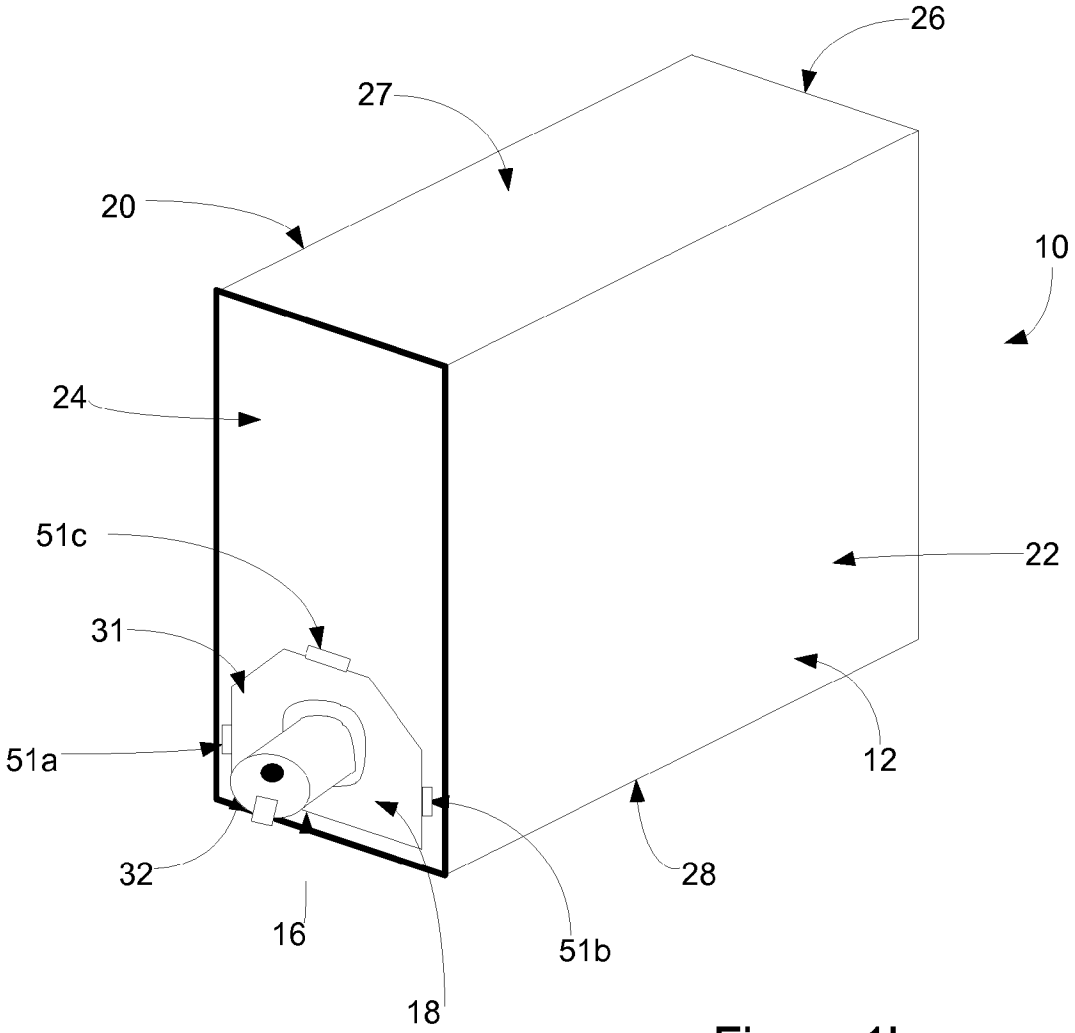
FIG. 1*b* of the drawings is a perspective view of a bag in box package made in accordance with the teaching of the present invention, showing in particular, the tap in a deployed tap dispensing position.
Figure 3:
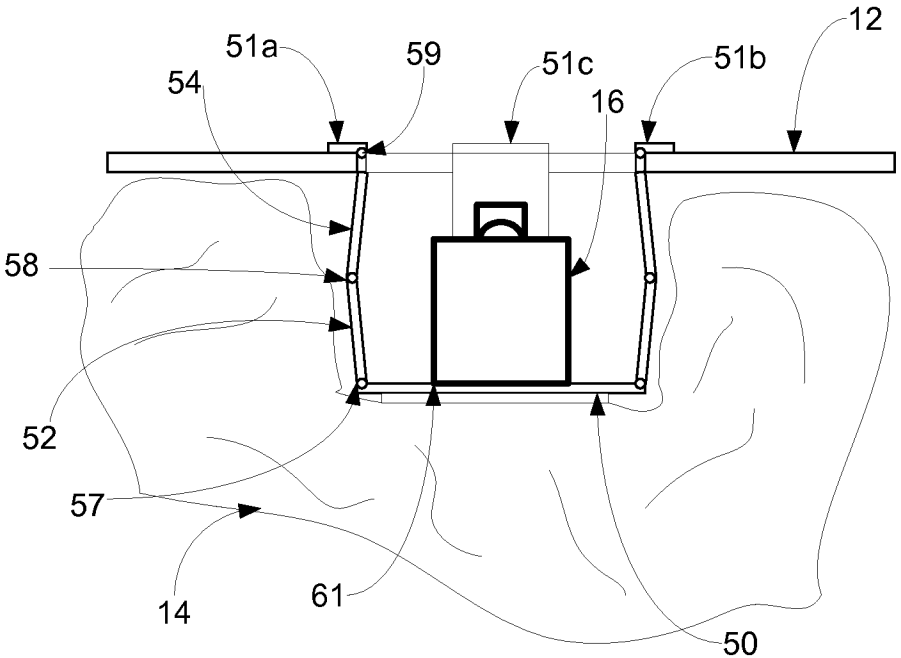
FIG. 3 of the drawings is a bottom plan view of the tap articulating assembly used in association with the outer box of the present invention.

The bag in box packaging is shown in FIGS. 1*a* and 1*b* as comprising outer box 12, inner bag 14, tap 16 and tap articulating assembly 18. The outer box 12 comprises a generally rectangular cubic container (although variously shaped containers are contemplated for use). The outer box 12 includes first sidewall 20, second sidewall 22, front wall 24 (also referred to as the dispensing wall), back wall 26, top wall 27 and bottom wall 28. In the configurations shown, the first and second sidewalls have a larger surface area than the remaining walls. The front wall and the back wall comprise narrow, elongated wall structures. Again, a number of different shapes are contemplated, and the foregoing comprises a description of a preferred embodiment.

In the embodiment shown, the outer box 12 may comprise a corrugated paperboard material. In other embodiments, the outer box may comprise a single or multiply paperboard material. In still other embodiments, corrugated polymer board, or polymer board may be utilized. Indeed, the invention is not limited to any particular material from which the outer box 12 is formed.

The dispensing wall 24 includes opening 30 at the lower end thereof. The opening is defined by perimeter edge 31. In the embodiment shown, the perimeter edge 31 comprises a arched shaped opening. Additionally, the opening may include a bottom wall opening as well, although, this may be omitted in certain embodiments. The opening is sized so as to permit a user to stick his or her hand through the opening and to retrieve the tap which is positioned within the outer box through the opening. In certain embodiments, the opening 30 may be covered with a separate frangible cover, such as a cover made from a clear polymer film, a paperboard substrate, a metal foil member, or another covering material. This prevents inadvertent actuation of the tap 16 accessible through the opening during shipment and storage prior to use.

Figure 2:
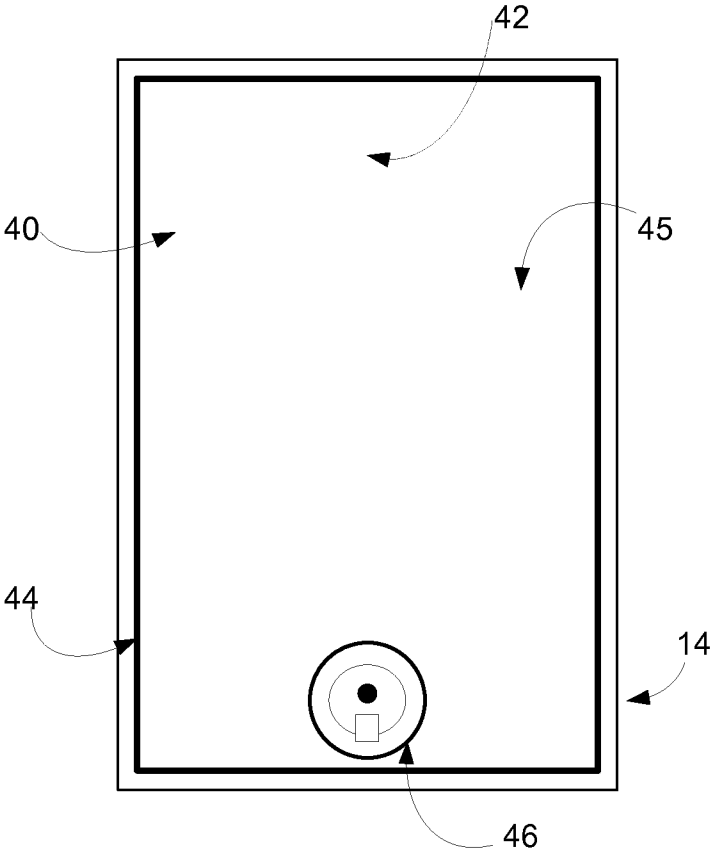
FIG. 2 of the drawings is a front elevational view of the inner bag which is inserted into the outer box of the present invention.

The inner bag 14 is shown in FIG. 2 as comprising front panel 40, back panel 42, seals 44 and spout 46. The inner bag 14 is shown as comprising a conventional pillow-type container. In other embodiments, gusseted containers are likewise contemplated for use. The front panel 40 and the back panel 42 are generally coextensive and positioned in an overlying configuration. The two panels are joined together with seals, such as seals 44 which generally extend about the periphery of the two panels. The seals and the front and back panel cooperate to define cavity 45 which is substantially fluid-tight cavity. Spout 46 provides ingress and egress of fluid into and from within the cavity 45. The spout typically includes a flange that is welded to the inside or the outside of the front panel, and includes a plurality of flanges disposed along the length thereof. The inner bag is sized so as to fit within the outer box.

Tap 16 is coupled to the spout 46. The tap 16 may comprise any number of different types and styles of taps. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb. Of course, other taps are likewise contemplated. The foregoing patents are incorporated by reference herein in their entirety.

The tap articulating assembly 16 is shown in the figures as comprising tap wall 50, and at least two opposing hinge assemblies, such as hinge assemblies 51*a*, 51*b* and 51*c*. The tap wall 50 is shown in FIG. 1 as comprising a substantially planar member having an opening 61 extending therethrough. The tap 16 is configured to extend through the opening 61, and the tap wall 50 may be either mechanically or adhesively coupled to the tap, spout and/or inner bag. The first hinge assembly 51*a* will be described with the understanding that the second hinge assembly 51*b* and 51*c* are each a substantially identical mirror image of the first hinge assembly 51*a*. First hinge assembly 51*a* comprises first hinge panel 52, second hinge panel 54, inner hinge fold 57, intermediate hinge fold 58 and outer hinge fold 59. In other embodiments, there may be additional hinge assemblies which extend about the arched portion of the opening, whereas the hinge assemblies 51*a*, 51*b* are on opposing sides of each other, and the hinge assembly 51*c* is overhead of the tap.

The first hinge panel 51 of the opposing hinge assembly 51*a* is coupled proximate the inner hinge fold 57 to the tap wall 50. The second hinge panel 51 is coupled to the first hinge panel 51 at the intermediate hinge fold 58. The second hinge panel 51 is coupled to the front wall 24 (or to one of the side walls 20, 22) at outer hinge fold 59. Each of the hinge folds 57, 58 and 59 facilitate the first and second hinge panels to pivotably rotate relative to each other and relative to the tap wall and the front wall (or the side walls).

The tap articulating assembly 16 allows for the movement of the tap from a shipping orientation wherein the tap is substantially fully contained with the footprint of the outer box to a dispensing orientation wherein the tap is fully exposed and outside of the confines of the outer box. In the embodiment shown, the footprint of the outer box substantially corresponds to the shape of the bottom wall. In other embodiments, the footprint of the outer box may be larger than the configuration of the bottom wall, as the upstanding walls may extend outwardly. In the embodiment shown, the tap wall, in the deployed orientation, is substantially flush with the front wall 24.

In the embodiment shown, each of the hinge panels facilitate the centering of the tap so that the tap wall properly interfaces with the opening. In the embodiment shown, the tap wall substantially corresponds in configuration to the opening 30 in the front wall.

Figure 4A:
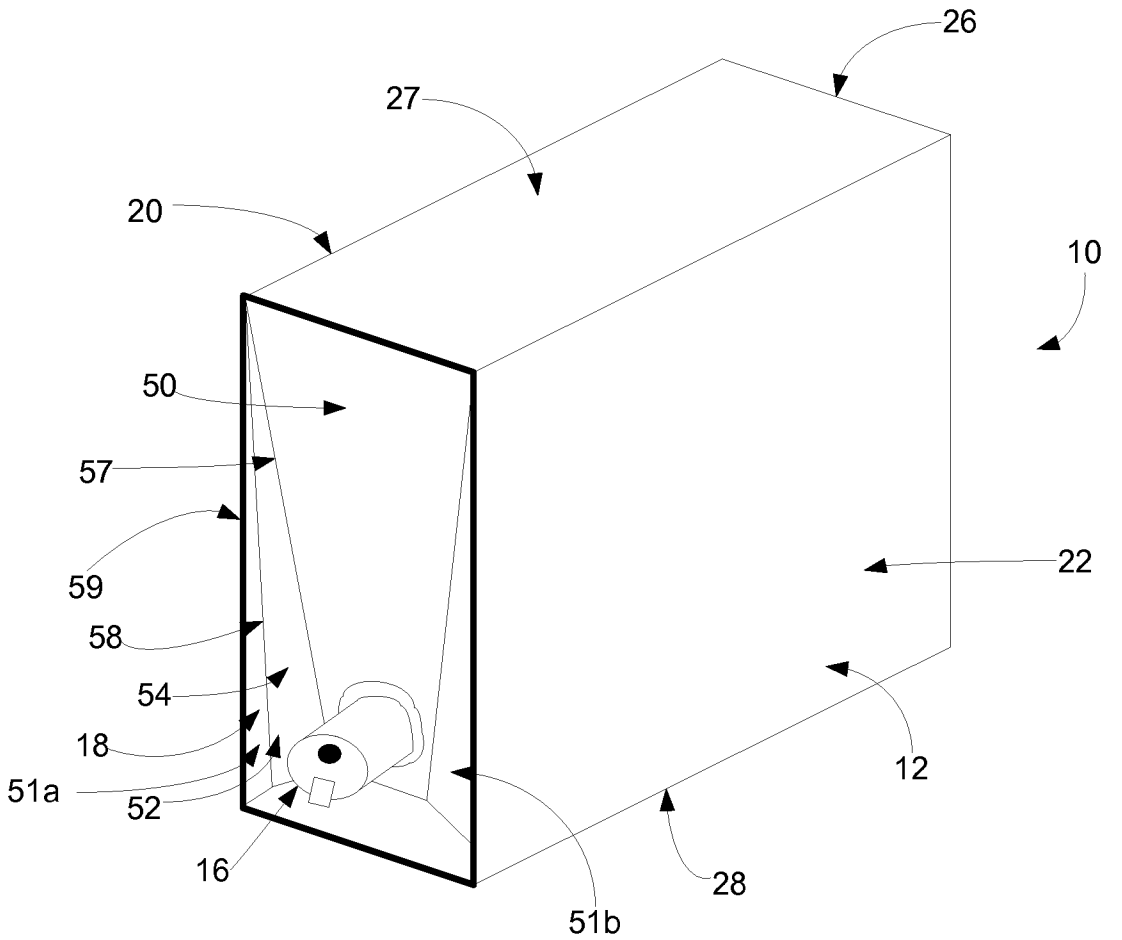
FIG. 4*a* of the drawings is a perspective view of a bag in box package made in accordance with the teachings of the present invention, showing in particular, the tap in a storage and shipping position.
Figure 4B:
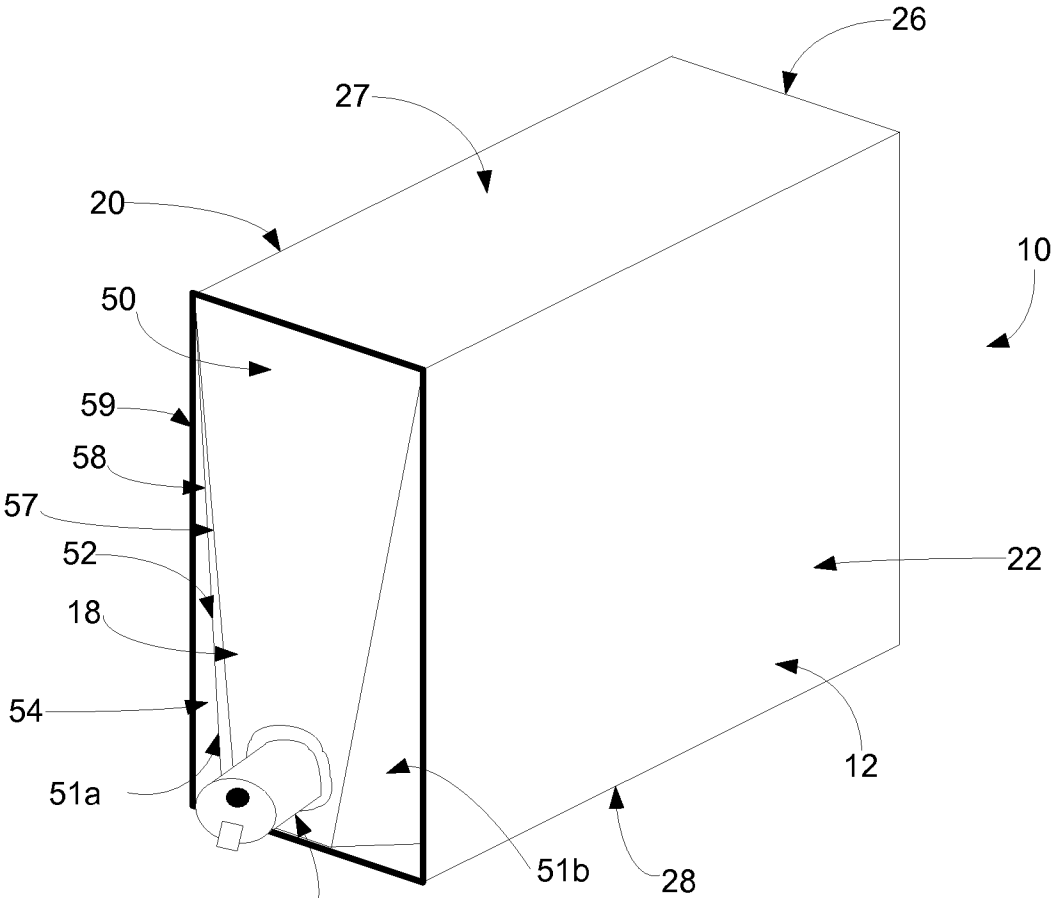
FIG. 4*b* of the drawings is a perspective view of a bag in box package made in accordance with the teaching of the present invention, showing in particular, the tap in a deployed tap dispensing position.

In another embodiment, as is shown in FIGS. 4*a* and 4*b*, the entire front wall is replaced with the tap articulating assembly 18. Specifically, the tap wall comprises planar member having inwardly angled walls so that the tap wall is narrower at the bottom and wider at the top. At the bottom, the tap wall is slightly wider than the tap body itself. At the top, the tap wall is substantially the same width as the width of the top wall.

In this embodiment, the two hinge panels 52, 54 of the first hinge assembly 51*a* extend the entire length of the tap wall (which is substantially trapezoidal), or, from the top wall to the bottom wall. The first hinge assembly is substantially triangular in configuration with the second hinge assembly comprising a substantially triangular configuration. The inner, intermediate and outer hinge folds substantially extend the entirety of the tap wall as well. In the shipping configuration, substantially the entirety of the tap wall is recessed between the two side walls 20, 22 of the outer box. In the dispensing configuration, the tap wall is substantially flush with the edges of the opposing sidewalls and the tap extends beyond the confines of the outer box. As the tap wall takes up the entirety of the area of the front wall, and inasmuch as much of the wall is movable, many embodiments may have a frangible cover over the entirety of the tap wall to protect the tap wall and the tap itself during shipment and transport. It will be understood that in other embodiments other shapes and sizes for the tap wall are contemplated.

In operation of either of the embodiments (and the operation will be described with respect to the first embodiment), the tap, spout and/or bag are coupled to the tap wall. The tap wall is configured into a shipping configuration so that the tap is fully contained within the footprint of the outer box 12. The bag in box packaging can then be shipped.

To dispense product, the user merely grasps the tap itself and pulls on the tap to withdraw the tap from the confines of the outer box 12. As the user pulls the tap, the tap wall begins to move forward. The tap articulating assembly then serves to guide the tap into the dispensing orientation from the shipping orientation. Specifically, once pulled, the hinge panels 51*a*, 51*b* rotate about the respective inner hinge fold 57, intermediate hinge fold 58 and outer hinge fold 59 until the tap is guided into the dispensing position. Once guided into the proper orientation, the tap is substantially precluded from further movement and the tap is maintained in the dispensing orientation.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An outer box for bag in box packaging comprising:

a plurality of walls configured to retain a bag therein, and including a bottom wall and a front wall;

a tap articulating assembly forming at least a portion of the front wall, and including:

a tap wall with an opening, configured to receive a tap coupled to a bag therethrough;

at least two hinge assemblies, each hinge assembly having a first hinge panel and a second hinge panel, the first and second hinge panels of each hinge assembly joined to each other at an intermediate hinge fold, with the first hinge panel joined to the tap wall at an inner hinge fold and to one of the front wall and a respective side wall at the outer hinge fold, with the first hinge assembly being spaced apart from the second hinge assembly, wherein the at least two hinge assemblies provide for a shipping orientation wherein the tap wall is recessed so as to substantially retain a tap within a footprint of the outer box to an dispensing orientation wherein a tap extends beyond the footprint of the outer box, wherein the tap wall and the at least two hinge assemblies are formed into the front wall, and the opening of the outer box extends about a bottom edge of the front wall, and wherein the intermediate hinge fold, the inner hinge fold and the outer hinge fold of the first hinge assembly intersect at a point on the front wall, and the intermediate hinge fold, the inner hinge fold and the outer hinge fold of the second hinge assembly intersect at a point on the front wall which is spaced apart from the intersection of the folds of the first hinge assembly.

2. The outer box for a bag in box packaging of claim 1 wherein the folds of the first hinge assembly intersect at a first corner of the front wall and the folds of the second hinge assembly intersect at a second corner of the front wall.

3. The outer box for a bag in box packaging of claim 1 wherein the outer box comprises a rectangular cubic configuration having opposing side walls, a top wall spaced apart from the bottom wall, a back wall opposite the front wall, and opposing sidewalls spanning between the front wall and the back wall on opposing sides.

4. The outer box for a bag in box packaging of claim 3 wherein the tap wall is substantially perpendicular to the opposing sidewalls upon positioning into the dispensing orientation.

5. The outer box for a bag in box packaging of claim 3 wherein the tap wall is hinged to the top wall.

6. The outer box for a bag in box packaging of claim 3 wherein the opening for a tap is closer to the bottom wall than to the top wall.

7. The outer box for a bag in box packaging of claim 3 wherein in the shipping orientation, the tap wall extends within a footprint of the bottom wall so as to expose a portion of an upper surface of the bottom wall.

8. The outer box for a bag in box packaging of claim 3 wherein the tap articulating assembly is coupled to each of the opposing sidewalls and the top wall, while being slidably movable relative to the bottom wall.

9. A bag in box packaging comprising:

an outer box having a bottom wall and a front wall;

an inner bag having a spout with a tap;

a tap articulating assembly forming at least a portion of the front wall and including:

a tap wall with an opening, the tap extending through the opening of the tap wall;

at least two hinge assemblies, each hinge assembly having a first hinge panel and a second hinge panel, the first and second hinge panels of each hinge assembly joined to each other at an intermediate hinge fold, with the first hinge panel joined to the tap wall at an inner hinge fold and to one of the front wall and a respective side wall at the outer hinge fold, with the first hinge assembly being spaced apart from the second hinge assembly, wherein the at least two hinge assemblies provide for a shipping orientation wherein the tap wall is recessed so as to substantially retain the tap within a footprint of the outer box to an dispensing orientation wherein the tap extends beyond the footprint of the outer box, wherein the tap wall and the at least two hinge assemblies are formed into the front wall, and the opening of the outer box extends about a bottom edge of the front wall, and wherein the intermediate hinge fold, the inner hinge fold and the outer hinge fold of the first hinge assembly intersect at a point on the front wall, and the intermediate hinge fold, the inner hinge fold and the outer hinge fold of the second hinge assembly intersect at a point on the front wall which is spaced apart from the intersection of the folds of the first hinge assembly.

10. The bag in box packaging of claim 9 wherein each of the first hinge panel and the second hinge panel comprise substantially triangular shaped structures.

11. The bag in box packaging of claim 10 wherein the tap wall comprises a substantially trapezoidal shaped structure.

12. A bag in box packaging comprising:

an outer box having a bottom wall and a front wall;

an inner bag having a spout with a tap;

a tap articulating assembly forming at least a portion of the front wall and including:

a tap wall with an opening, the tap extending through the opening of the tap wall;

at least two hinge assemblies, each hinge assembly having a first hinge panel and a second hinge panel, the first and second hinge panels of each hinge assembly joined to each other at an intermediate hinge fold, with the first hinge panel joined to the tap wall at an inner hinge fold and to one of the front wall and a respective side wall at the outer hinge fold, with the first hinge assembly being spaced apart from the second hinge assembly, wherein the at least two hinge assemblies provide for a shipping orientation wherein the tap wall is recessed so as to substantially retain the tap within a footprint of the outer box to an dispensing orientation wherein the tap extends beyond the footprint of the outer box, wherein the tap wall and the at least two hinge assemblies are formed into the front wall, and the opening of the outer box extends about a bottom edge of the front wall, and wherein the folds of the first hinge assembly intersect at a corner of the front wall and the folds of the second hinge assembly intersect at a corner of the front wall.

13. The bag in box packaging of claim 12 wherein the folds of the first hinge assembly and the folds of the second hinge assembly are mirror images of each other about a central axis extending longitudinally about the front wall.

* * * * *